US010128623B2

(12) United States Patent
Barlemont et al.

(10) Patent No.: US 10,128,623 B2
(45) Date of Patent: Nov. 13, 2018

(54) WALL BUSHING FOR PLUG CONNECTORS

(71) Applicant: HARTING ELECTRONICS GMBH, Espelkamp (DE)

(72) Inventors: Arnaud Barlemont, Sagy (FR); Dieter Luettermann, Rahden (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 15/535,352

(22) PCT Filed: Dec. 4, 2015

(86) PCT No.: PCT/DE2015/100518

§ 371 (c)(1),
(2) Date: Jun. 12, 2017

(87) PCT Pub. No.: WO2016/091251

PCT Pub. Date: Jun. 16, 2016

(65) Prior Publication Data

US 2017/0352993 A1 Dec. 7, 2017

(30) Foreign Application Priority Data

Dec. 11, 2014 (DE) ..... 10 2014 118 392

(51) Int. Cl.
*H01R 13/74* (2006.01)
*H01R 13/52* (2006.01)
(Continued)

(52) U.S. Cl.
CPC ..... *H01R 13/748* (2013.01); *H01R 13/506* (2013.01); *H01R 13/5219* (2013.01);
(Continued)

(58) Field of Classification Search
CPC ..... H01R 13/73; H01R 13/748; H01R 13/74; H01R 13/514
(Continued)

(56) References Cited

U.S. PATENT DOCUMENTS 8,152,562 B2 * 4/2012 Gross ..... H01R 13/748 439/374
8,550,859 B2 * 10/2013 Van Swearingen ..... H01R 13/514 439/660
(Continued)

FOREIGN PATENT DOCUMENTS

DE 202008011281 1/2009 ..... H01R 13/74
DE 102008047145 4/2010 ..... H01R 13/52
(Continued)

OTHER PUBLICATIONS

International Search Report issued in corresponding PCT Application Serial No. PCT/DE2015/100518 dated Apr. 8, 2016 with English translation (7 pages).
(Continued)

*Primary Examiner* — Vanessa Girardi
(74) *Attorney, Agent, or Firm* — Hayes Soloway P.C.

(57) ABSTRACT

Provided is a wall bushing for establishing contact between a plug connector and a housing wall or the like. The wall bushing can be placed and fastened over an opening by three fastening bores. Advantageous arrangement of the three fastening bores ensures that the wall bushing is fitted on the housing in a particularly safe and stable manner. The special shaping of the wall bushing additionally allows a high mounting density of a large number of wall bushings in a small area.

6 Claims, 5 Drawing Sheets

(51) Int. Cl.

| | |
|---|---|
| ***H01R 13/506*** | (2006.01) |
| *H01R 24/52* | (2011.01) |
| *H01R 13/621* | (2006.01) |
| *H01R 13/627* | (2006.01) |
| *H01R 13/514* | (2006.01) |

(52) U.S. Cl.
CPC ..... *H01R 13/6273* (2013.01); *H01R 13/746* (2013.01); *H01R 13/514* (2013.01); *H01R 13/627* (2013.01); *H01R 13/6215* (2013.01); *H01R 24/52* (2013.01)

(58) Field of Classification Search
USPC ..... 439/569, 562, 564, 544
See application file for complete search history.

(56) References Cited

U.S. PATENT DOCUMENTS

| | | | | |
|---|---|---|---|---|
| 2011/0189872 | A1 | 8/2011 | Bruenger | H01R 13/44 |
| 2011/0235977 | A1 | 9/2011 | Yamada | G02B 6/36 |
| 2013/0102200 | A1 | 4/2013 | Swearingen | H01R 24/76 |
| 2013/0171854 | A1 | 7/2013 | Homme | H01R 13/5202 |
| 2015/0378117 | A1 | 12/2015 | Bussmann et al. | G02B 6/42 |

FOREIGN PATENT DOCUMENTS

| | | | |
|---|---|---|---|
| DE | 102013101267 | 8/2014 | H01R 13/424 |
| EP | 2369690 | 9/2011 | H01R 17/74 |
| EP | 2597730 | 5/2013 | H01R 13/52 |
| WO | WO2010/028738 | 3/2010 | H01R 13/52 |

OTHER PUBLICATIONS

Written Opinion of the International Search Authority issued in corresponding PCT Application Serial No. PCT/DE2015/100518 (5 pages).

International Preliminary Report on Patentability issued in corresponding PCT Application Serial No. PCT/DE2015/100518 dated Feb. 27, 2017 with English translation (12 pages).

* cited by examiner

WALL BUSHING FOR PLUG CONNECTORS

DESCRIPTION

The invention relates to a wall feedthrough bushing for plug connectors.

Wall feedthrough bushings of this type are required in order to connect plug connectors to mating plug connectors that are received on or behind a wall. Wall feedthrough bushings are used to provide the mechanical contact with and latching to the plug connectors. The mating plug connector is mainly fixed in a mechanical manner behind the wall on by way of example a circuit board and said mating plug connector cannot move relative to the wall feedthrough bushing.

The fields of application of wall feedthrough bushings of this type range from control cabinets through device casings and control devices as far as switch boxes and other walls through which cables are to be guided by means of a plug connector. Such cables are preferably electrical cables or optical cables.

PRIOR ART

DE 10 2008 047 145 B3 illustrates a plug connector wall feedthrough bushing for industrial environmental conditions. The wall feedthrough bushing comprises a flange that can be fastened to a wall by means of two or four screws. A seal is arranged between the flange and the wall and said seal is compressed by means of the screws. A mounting frame is arranged on the flange and said mounting frame is used to make contact with a plug connector.

A disadvantage in the case of the wall feedthrough bushings of this type is the large construction of the flange contour. This is required in order to connect the wall feedthrough bushing securely to the wall. However, wall feedthrough bushings of this type require a large amount of space. In the case of the arrangement of four screws around the mounting frame, a large amount of space if required for the flange and the bore holes for the screws.

As an alternative to the arrangement of four screws, solutions that have only two screws are known. These are arranged on two sides adjacent to the mounting frame. However, in this arrangement, a large amount of pressure is applied to the seal in the region of the screws in order to ensure that the mounting frame is also sealed on the long region between the screws.

In addition, the mounting of wall feedthrough bushings of this type having only two screws is very susceptible to lateral loadings that can occur by means of a plug connector. It is thus possible for a later loading to occur as a result of pulling forces on the plug connector (e.g. as a result of the intrinsic weight of the cable). Furthermore, a subsequent force moment can be exerted on the wall feedthrough bushing as a result of the plug connector being plugged into the wall feedthrough bush or pulled out therefrom in a non-linear manner. It is possible especially when this force moment acts in a transverse manner with respect to the alignment of the two screws that the sealing arrangement is relaxed on one side and the connection becomes no longer tight.

OBJECT OF THE INVENTION

The object of the invention resides in providing a wall feedthrough bushing for plug connectors that solves the known problems of the known wall feedthrough bushings.

In particular, the wall feedthrough bushing is to require a small amount of space for mounting on the wall and it is to be possible to arrange said wall feedthrough bushings in a high packing density adjacent to one another. In addition, the wall feedthrough bushing is not to be sensitive to the influence of lateral forces that occur and it is also to remain tight even in the case of large lateral forces.

The invention relates to a wall feedthrough bushing for plug connectors. The wall feedthrough bushing comprises a fastening flange that is provided for mounting on a wall. The fastening flange comprises a through-going opening for feeding through cables or plug connectors.

A collar is provided on one side of the fastening flange. The collar surrounds the through-going opening. The collar comprises on the outer face latching means so that the collards suitable for latching in a mechanical manner with a plug connector housing.

The face of the fastening flange that is remote from the collar is provided for mounting on a wall. For this purpose, this side comprises a seal that can be compressed between the fastening flange and a wall.

Three fastening openings are provided in the fastening flange so as to fasten the wall feedthrough bushing to a wall. The fastening openings are preferably embodied as bore holes and are provided to receive screws. Screws in the fastening openings in the fastening flange render it possible for said fastening flange to be screwed in this manner to a wall and to compress the seal. The seal is preferably embodied in such a manner that it at least surrounds the through-going opening so as to seal said opening.

In a preferred embodiment, the collar that is provided for latching with a plug connector is rectangular in shape. The collar is thus arranged in such a manner that the fastening flange surrounds the collar on three sides. It is preferred that two shorter sides of the rectangular collar and also a longer side of the collar that lies between the two said shorter sides are surrounded by the fastening flange.

The three fastening openings are expediently arranged on the two regions of the fastening flange that are located adjacent to the shorter sides of the rectangular collar. Two fastening boreholes are thus integrated in a first of the two regions of the fastening flange and one fastening borehole is provided in the second region.

A particularly advantageous embodiment provides that the fastening borehole in the second region of the fastening flange is arranged with one of the two other fastening boreholes in a point-symmetrical manner with respect to the middle point of the rectangular collar. The remaining fastening bore is thus as far as possible away from the connecting axis of the point-symmetrically arranged fastening bores. This arrangement renders possible a particularly large lever force on the wall feedthrough bushing if a lateral force is exerted. By virtue of this three-point fastening arrangement, the wall feedthrough bushing lies against a wall in a manner particularly free of clearance. Said wall feedthrough bushing cannot tilt.

A further embodiment provides that the fastening flange is not embodied in a uniformly wide manner around the collar. In the first and the second region of the fastening flange, said fastening flange is cut-away between the fastening boreholes. This provides the fastening flange with a jigsaw puzzle piece shape in the first and second region around the fastening boreholes.

In a particularly preferred further development of this embodiment, the first region of the fastening flange comprises the negative shape of the second region of the fastening flange. This means that the first region of the fastening flange of a first wall feedthrough bushing can be joined in an inter-locking manner to the second region of the fastening flange of a second wall feedthrough bushing. The two wall feedthrough bushings can be joined adjacent to one another in a jigsaw puzzle manner. This renders it possible to fasten multiple wall feedthrough bushings adjacent to one another with a very small spacing without losing a lot of free space for in each case a dedicated fastening flange.

EXEMPLARY EMBODIMENT

The exemplary embodiment of the invention is illustrated in the drawings and is explained in detail hereinunder. In the drawings.

The figures shows in part simplified schematic illustrations. On occasions, identical reference numerals are used for like but possibly non-identical elements. Different views of like elements can be scaled differently.

Figure 1:
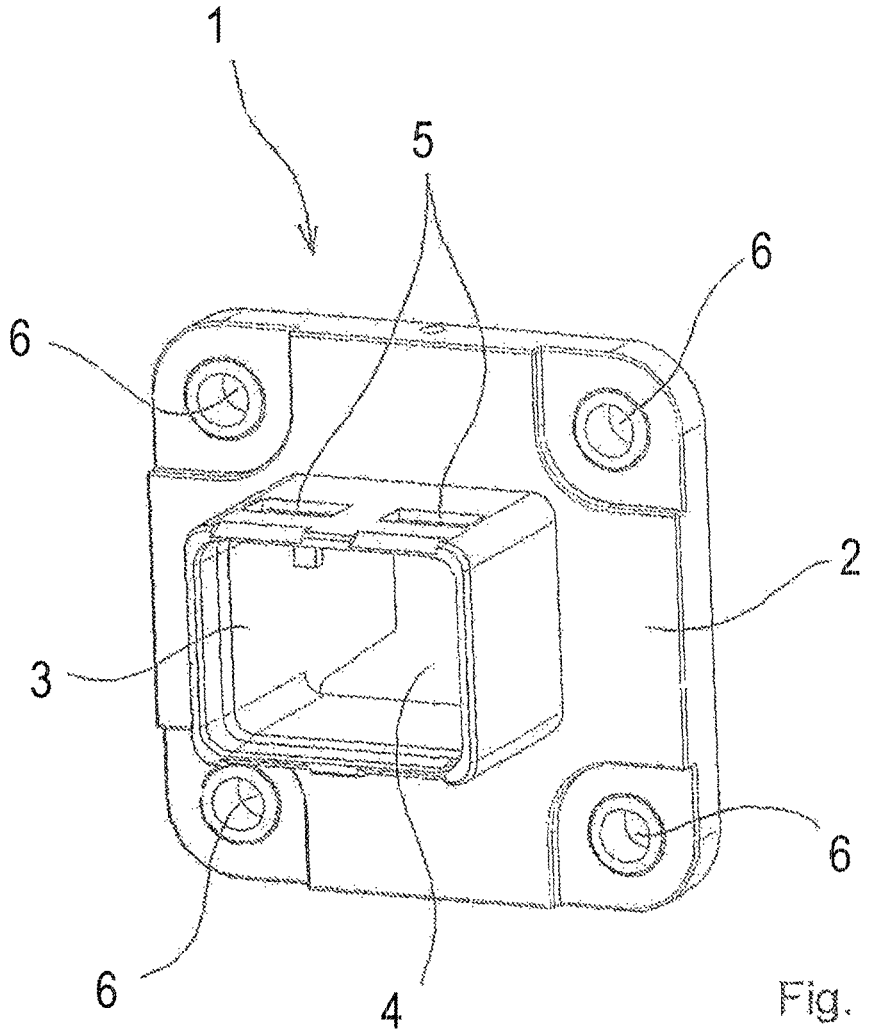
Fig. 1 Prior Art
FIG. 1 illustrates a perspective view of a wall feedthrough bushing that is known from the prior art.

The FIG. 1 illustrates a perspective view of a wall feedthrough bushing 1 known from the prior art. The wall feedthrough bushing 1 is formed from a fastening flange 2 that comprises a centrally arranged rectangular through-going opening 4. A collar 3 is arranged around the through-going opening 4. The collar 3 is provided so as to make contact and latch with a plug connector.

The collar 3 is rectangular in shape and extends away from the fastening flange 2. Latching means 5 are provided on the outer face of the collar 3 and said latching means are provided so as to latch in a mechanical manner with a mating plug. The latching means are embodied in this example as latching indents into which latching arms of a mating plug connector can engage. Alternatively, a thread or latching means could also be provided here for a bayonet connection.

The fastening flange 2 comprises moreover four fastening openings 6. The fastening openings 6 are arranged in the corners of the square fastening flange 2. This arrangement renders it possible to fasten the fastening flange 2 to a housing wall in a most secure manner as possible. The large contact surface of the fastening flange 2 is connected at all four corners to a wall.

As a consequence, the largest possible force is transmitted from the fastening flange 2 to a housing wall. This is above all advantageous in the case of transverse forces occurring at the collar 3 since said forces can be easily diverted and easily absorbed by means of a housing wall.

The amount of mounting surface required in the case of the illustrated wall feedthrough bushing 1 is a disadvantage. As a result of the relatively large fastening flange 2, a very large amount of contact area is required on a housing wall against which the fastening flange 2 can lie and to which said fastening flange can be screwed by means for example of screws through the fastening openings 6.

Figure 2:
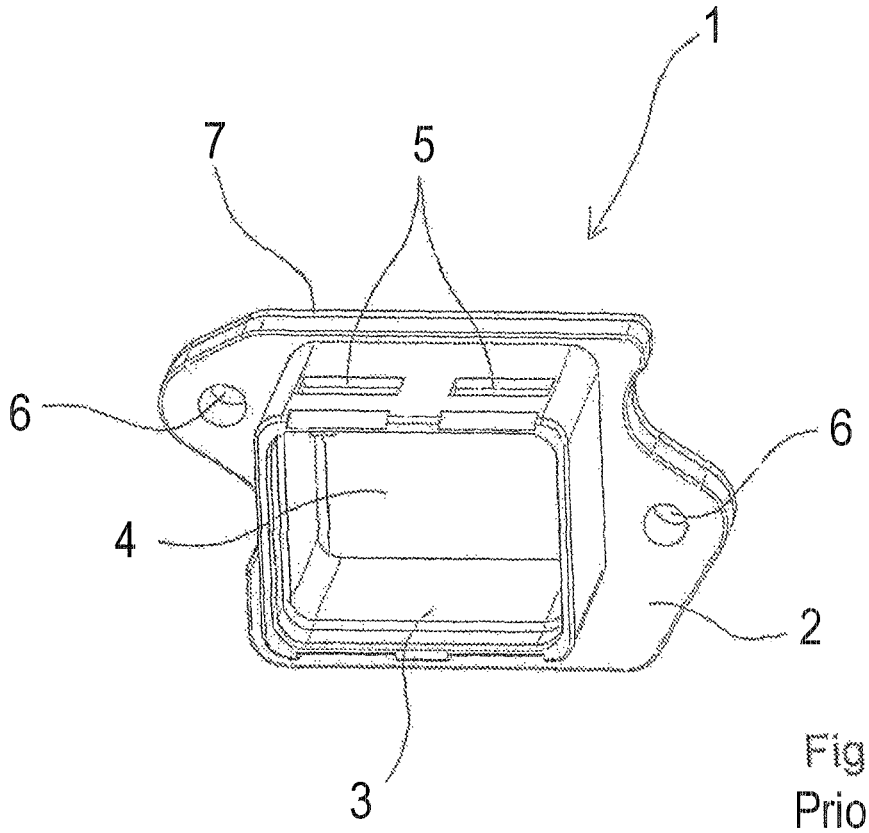
Fig. 2 Prior Art
FIG. 2 illustrates a perspective view of a further wall feedthrough bushing that is known from the prior art.

This disadvantage is eliminated in the case of a wall feedthrough bushing 1 according to FIG. 2. The fastening flange 2 has been considerably reduced in size in this embodiment of a wall feedthrough bushing 1 that is likewise known in the prior art.

The fastening flange 2 is considerably reduced in size. The fastening flange 2 is almost completely removed above the through-going opening 4 and the collar 3. The fastening flange 2 is still only provided in the lateral regions around the fastening openings 6. The remaining regions have been cut away.

By virtue of cutting away the fastening flange 2 around the fastening openings 6, it is possible to insert two wall feedthrough bushings 1 into one another. The wall feedthrough bushings 1 can be mounted adjacent to one another in a considerably denser arrangement in that the fastening flange 2 of one wall feedthrough bushing 1 engages in the cut-out of an adjacent fastening flange 1.

In addition, the fastening flange 2 comprises only two fastening openings 6 in lieu of four. A good fastening arrangement is achieved by means of expediently positioning the fastening holes 6 on a diagonal through the middle point of the through-going opening 4 and the collar 3.

However, it is a disadvantage of this embodiment of a wall feedthrough bushing 1 that said wall feedthrough bushings are extremely unstable in the case of forces that act upon the collar 3 in a transverse direction with respect to the plugging-in direction. The entire wall feedthrough bushing 1 can tilt especially if forces occur in a transverse manner with respect to the axis between the fastening openings 6 as a result of the cable being pulled or as the plug connector is inserted or removed.

If the connection between the fastening flange 2 and a wall is still to be sealed by means of a seal 7, traverse loadings can also cause said seal to be compressed and the wall feedthrough bushing 1 to become no longer tight. It is possible by way of example for an upwardly directed force on the collar 3 of the wall feedthrough bushing 1 shown in FIG. 2 to lead to the seal 7 being further compressed in the upper region and. for a gap to occur in the lower region of the fastening flange 2. As a result, moisture or other contaminants can penetrate.

Figure 3:
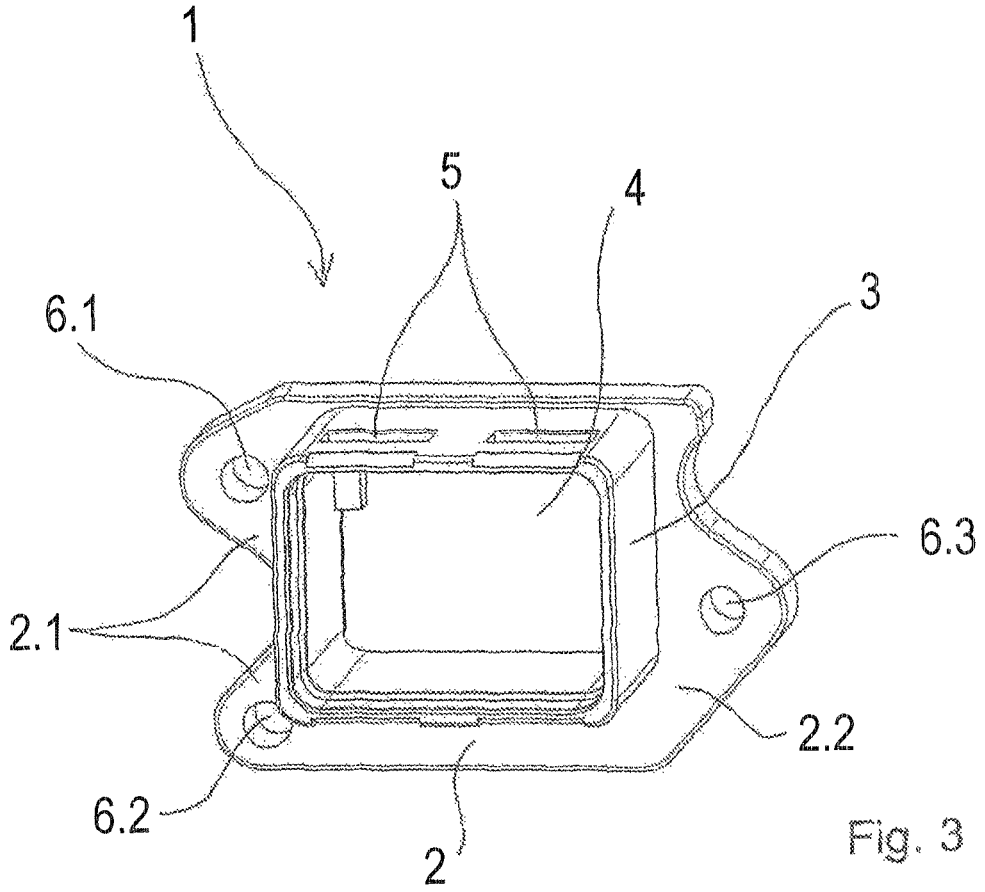
FIG. 3 illustrates a perspective view of a wall feedthrough bushing in accordance with the invention.

A perspective view of a wall feedthrough bushing 1 in accordance with the invention is illustrated in FIG. 3. The wall feedthrough bushing 1 comprises essentially the identical construction as for example known wall feedthrough bushings shown in FIG. 2. A fastening flange 2 is provided for fastening to a housing wall. By virtue of a through-going opening 4 in the fastening flange 2, a plug connector can be guided through the fastening flange 2 and connected to a mating plug connector.

A collar 3 is provided around the through-going opening 4 and said collar comprises latching means 5 for latching with a plug connector. In accordance with the invention, three fastening openings 6 (6.1, 6.2, 6.3) are integrated in the fastening flange 2. Screws, pins or rivets can be guided through the fastening openings 6 and can be used to fasten the fastening flange 2 to a housing wall.

The three fastening openings 6 are integrated into the fastening flange 2 in such a manner that it is possible to distribute force in the best possible manner over the fastening openings. For this purpose, two fastening openings 6.1, 6.2 are integrated in the left region 2.1 of the fastening flange 2. The fastening opening 6.1 is arranged in the upper portion of the region 2.1, whereas the fastening opening 6.2 is arranged in the lower portion of the region 2.1.

The right-hand region 2.2 of the fastening flange 2 is provided in the middle between the fastening openings 6.1, 6.2. The third fastening opening 6.3 is integrated in the left-hand region 2.2. The region 2.2 of the fastening flange 2 is thus embodied in such a manner that it only surrounds the fastening opening 6.3. The region 2.2 is cut away above and below the fastening opening 6.3.

The region 2.1 comprises a cut-out between the upper and lower portion and said cut-out is provided for receiving the region 2.2 of a further wall feedthrough bushing 1. As a consequence, two wall feedthrough bushings 1 can be mounted very close to one another.

Figure 4:
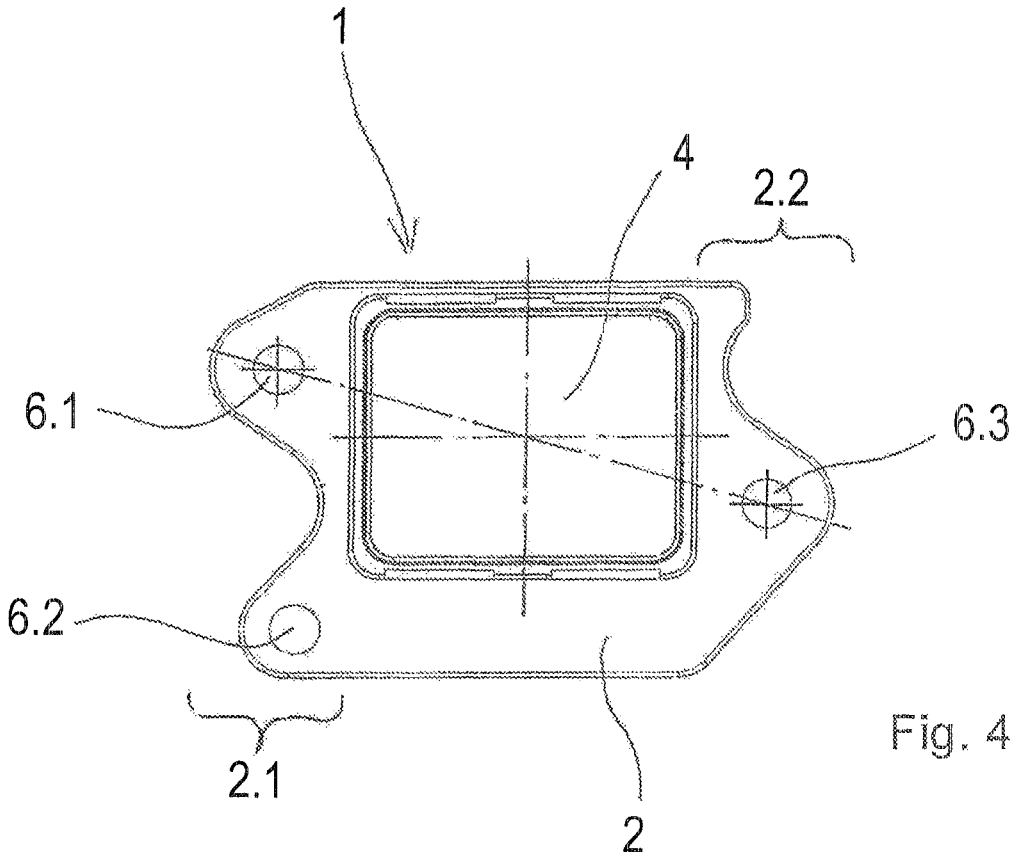
FIG. 4 illustrates a frontal view of the wall feedthrough bushing in accordance with the invention shown in FIG. 3.

FIG. 4 also illustrates in this instance a front view of the wall feedthrough bushing 1 shown in FIG. 4. In this case, the shape of the fastening flange 2 and also the arrangement of the fastening opening 6 are easily visible. The fastening openings 6.1, 6.3 lie on an axis through the middle point of the through-going opening 4 and are arranged in a point-symmetrical manner with respect to the middle point.

The fastening opening 6.2 is arranged in the lower portion of the region 2.1 of the fastening flange 2 so that a maximal spacing with respect to the middle point of the through-going opening 4 is produced. It is thus rendered possible to fasten the wall feedthrough bushing 1 in an optimal manner.

Figure 5:
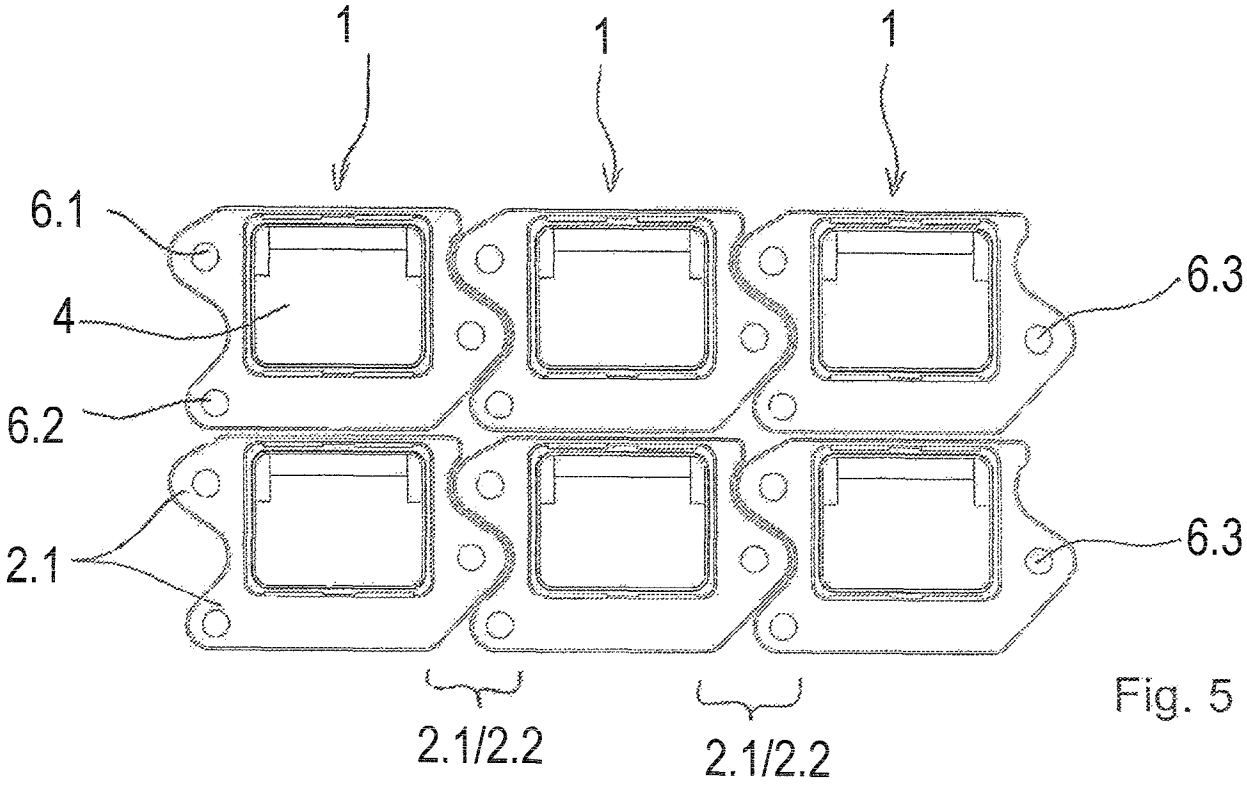
FIG. 5 illustrates a system comprising multiple wall feedthrough bushings that are joined together in a grid pattern.

The particular design of the regions 2.1 and 2.2 of the fastening flanges 2 is clear in FIG. 5. FIG. 5 illustrates a system comprising multiple wall feedthrough bushings 1 that are joined together in a grid pattern. Six wall feedthrough bushings 1 are arranged in two rows and three columns.

In each case, the region 2.1 of a wall feedthrough bushing 1 engages in the region 2.2 of the adjacent wall feedthrough bushing 1. The regions 2.1 and 2.2 are advantageously cut away around the fastening openings 6 in such a manner that the regions 2.1, 2.2 can engage in one another. It is thus possible to arrange multiple wall feedthrough bushings 1 adjacent to one another in a particularly close manner.

The object in accordance with the invention is achieved in a particularly advantageous manner by means of the arrangement in accordance with the invention of the three fastening openings 6.1, 6.2, 6.3 and the cut-outs around the fastening openings 6.1, 6.2, 6.3 in the regions 2.1, 2.2.

The invention claimed is:

1. A wall feedthrough bushing for plug rectangular shaped connectors, said wall feedthrough bushing comprising a planar fastening flange having a collar, wherein the collar surrounds a through-going opening that extends through the planar fastening flange, wherein the collar comprises a latch, wherein the planar fastening flange comprises precisely three fastening openings wherein two of the three fastening openings are arranged adjacent a shorter side of the rectangular collar in a point-symmetrical manner with respect to the middle point of the rectangular shape of the collar, and the other of the three fastening openings is arranged adjacent the opposite shorter side of the rectangular collar, wherein the planar fastening flange surrounds the collar precisely on three sides, and wherein the three fastening openings are arranged in two opposite-lying regions of the planar fastening flange, wherein the first region comprises two of the fastening openings and the second, opposite lying region comprises one fastening opening, and the two opposite lying regions of the planar fastening flange are cut away around the fastening openings and are adapted to engage in one another in a jigsaw puzzle-like manner, wherein like multiple feedthrough bushings may be fastened adjacent to one another with minimal spacing between adjacent bushings.

2. The wall feedthrough bushing as claimed in claim 1, wherein the collar is rectangular in shape.

3. A system comprising multiple wall feedthrough bushings as claimed in claim 1, wherein the wall feedthrough bushings are arranged adjacent to one another in at least one row, and the first region of a wall feedthrough bushing engages in each case in the second region of an adjacent wall feedthrough opening.

4. A system comprising multiple wall feedthrough bushings as claimed in claim 1, wherein the wall feedthrough bushings are arranged adjacent to one another in at least one row, and the first region of a wall feedthrough bushing engages in each case in the second region of an adjacent wall feedthrough opening.

5. The wall feedthrough bushing as claimed in claim 1, wherein planar fastening flange comprises a seal on the side that lies opposite the collar.

6. The wall feedthrough bushing as claimed in claim 5, wherein the seal surrounds at least the through-going opening.

* * * * *